US007749142B2

(12) United States Patent
Kuhagen

(10) Patent No.: US 7,749,142 B2
(45) Date of Patent: Jul. 6, 2010

(54) THERAPEUTIC DEVICE

(76) Inventor: Scott F. Kuhagen, 5441 1/2 Village Green, Los Angeles, CA (US) 90016

( * ) Notice: Subject to any disclaimer, the term of this patent is extended or adjusted under 35 U.S.C. 154(b) by 54 days.

(21) Appl. No.: 11/671,399

(22) Filed: Feb. 5, 2007

(65) Prior Publication Data

US 2007/0184946 A1 Aug. 9, 2007

Related U.S. Application Data

(60) Provisional application No. 60/765,645, filed on Feb. 5, 2006.

(51) Int. Cl.
*A63B 21/04* (2006.01)
*A63B 69/22* (2006.01)
*A63B 21/06* (2006.01)

(52) U.S. Cl. ..... 482/129; 482/90; 482/93

(58) Field of Classification Search ..... 482/83–90, 482/121, 127; 473/417–423
See application file for complete search history.

(56) References Cited

U.S. PATENT DOCUMENTS 519,918 A * 5/1894 Maclearn ..... 482/90
1,612,796 A * 12/1926 Abraham ..... 482/90
2,085,161 A * 6/1937 Kraus ..... 482/90
2,186,403 A * 1/1940 Bullis et al. ..... 482/90
4,830,371 A * 5/1989 Lay ..... 473/423
5,046,724 A * 9/1991 Sotomayer ..... 482/90
5,474,032 A * 12/1995 Krietzman et al. ..... 119/708
5,624,362 A * 4/1997 Wilson ..... 482/139
5,797,810 A * 8/1998 Sandoval ..... 473/423
5,899,835 A * 5/1999 Puranda ..... 482/90
6,398,671 B1 * 6/2002 Rios ..... 473/417
6,616,554 B2 * 9/2003 Liao ..... 473/417
6,786,854 B1 * 9/2004 Hsu ..... 482/83

* cited by examiner

*Primary Examiner*—Fenn C Mathew
(74) *Attorney, Agent, or Firm*—Kleinberg & Lerner, LLP; Marvin H. Kleinberg

(57) ABSTRACT

A physical therapy apparatus includes a pole, a weighted base, and one or more types of grips. Weights are attached to the pole near the grips to counterbalance gravitational forces on the user and to thereby provide evenly proportioned tension throughout the full range of motion of the apparatus as it is moved. The apparatus may be moved in virtually any direction, providing constant tension for working and stretching muscles to aid in recovery from muscle injuries.

6 Claims, 9 Drawing Sheets

BASEBALL ASSEMBLY

BASKETBALL ASSEMBLY

FOOTBALL ASSEMBLY

ARTICULATING ARC ASSEMBLY

DOUBLE SPIRAL HANDLE ASSEMBLY

SINGLE SPIRAL ARC ASSEMBLY

THERAPEUTIC DEVICE

CROSS REFERENCE TO RELATED APPLICATIONS

This is a continuation-in-part of my provisional application for patent entitled EXERCISE POLE, Ser. No. 60/765,645, filed Feb. 5, 2006.

STATEMENT REGARDING FEDERALLY SPONSORED RESEARCH/DEVELOPMENT

N/A

REFERENCE TO MICROFICHE APPENDIX

N/A

BACKGROUND OF THE INVENTION

1. Field of the Invention

The present invention relates to physiotherapy and, more particularly, an exercise device useful in rehabilitation from injuries.

2. Description of the Related Art

In the field of exercise equipment, there exist innumerable devices to promote strength, mobility, flexibility and to assist in rehabilitation from injuries to the body. Typical among them are training devices that utilize weights (in selectable amounts) to provide resistance to body movements, whether of the trunk, the arms, legs or selected muscle groups.

Other devices utilize the weight of the body to resist motion of either the body as a whole or of the extremities. Specialized devices exercise the abdominal muscles. Others concentrate on arms or legs. Many emulate athletically challenging activities, such as treadmills, ski simulators, stair climbers or bicycles. Recently, U.S. Pat. No. 7,115,078 B1, issued Oct. 3, 3006, described a pole with a spherical base that was encompassed by friction bands, permitting use of the pole as an exercise device with an adjustable resistance to motion. That device neither promotes flexibility or counters the body weight when undertaking range of motion exercises.

Injury or prolonged inactivity leads to reduced flexibility and mobility and compromised body strength, all of which limit the effectiveness of most prior art devices. Improving athletic performance, increasing pain free range of motion, improving posture, strength, mobility, balance, agility and, in particular, rehabilitation of the injured body, all require equipment not found in the prior art.

What is needed is a simple apparatus that aids in the aforementioned areas by countering the effects of gravity during exercise, thereby permitting movements in which the weight of the body and limbs are no longer limitations.

SUMMARY OF THE INVENTION

According to the present invention, an adjustable height pole is mounted to a weighted base with a flexible coupling member that resists non-coaxial motion. The pole can be provided with a plurality of interchangeable "handles", some of which may resemble various sports devices such as baseballs, footballs or basketballs for use with athletes of those sports.

It has been found desirable to utilize the pole with a weight set that can be selectably coupled to the pole so that pole motion can be resisted by weights of any preselected value. In alternative embodiments, elastic members may replace the weights where the elastic members have resistance to deformation in known magnitudes. Such elastic members may be elastomeric bands, calibrated springs, or flexible rods or wands that resist deformation.

For example, by tethering the pole to a moderate weight, the stress of a forward bend is alleviated somewhat, making it easier to recover with the assistance of the weights opposing the gravitational pull on the torso. Similarly, extreme stretches can be undertaken in a substantially weightless environment. The pole allows a greater freedom of movement in all directions as a direct benefit of the support afforded by the counterbalancing weights.

While weights are employed in the preferred embodiment, in an alternative embodiment, a strong coil spring may be used to join the base and the pole. A collar which is calibrated can limit the length of coil that is permitted to flex. The shorter the free coil, the stronger the resistance to movement.

Alternative handles can be provided with additional ranges of motion and degrees of freedom. Such handles can include swivels and gimbals to provide all degrees of freedom in the connection between person and machine. In addition, the handles may include simulated items of athletic equipment such as footballs or basketballs, racquet handles or equipment grips to facilitate exercises for a particular athletic activity.

The novel features which are characteristic of the invention, both as to structure and method of operation thereof, together with objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 2, including

FIG. 3, including

DETAILED DESCRIPTION OF THE INVENTION

Figure 1:
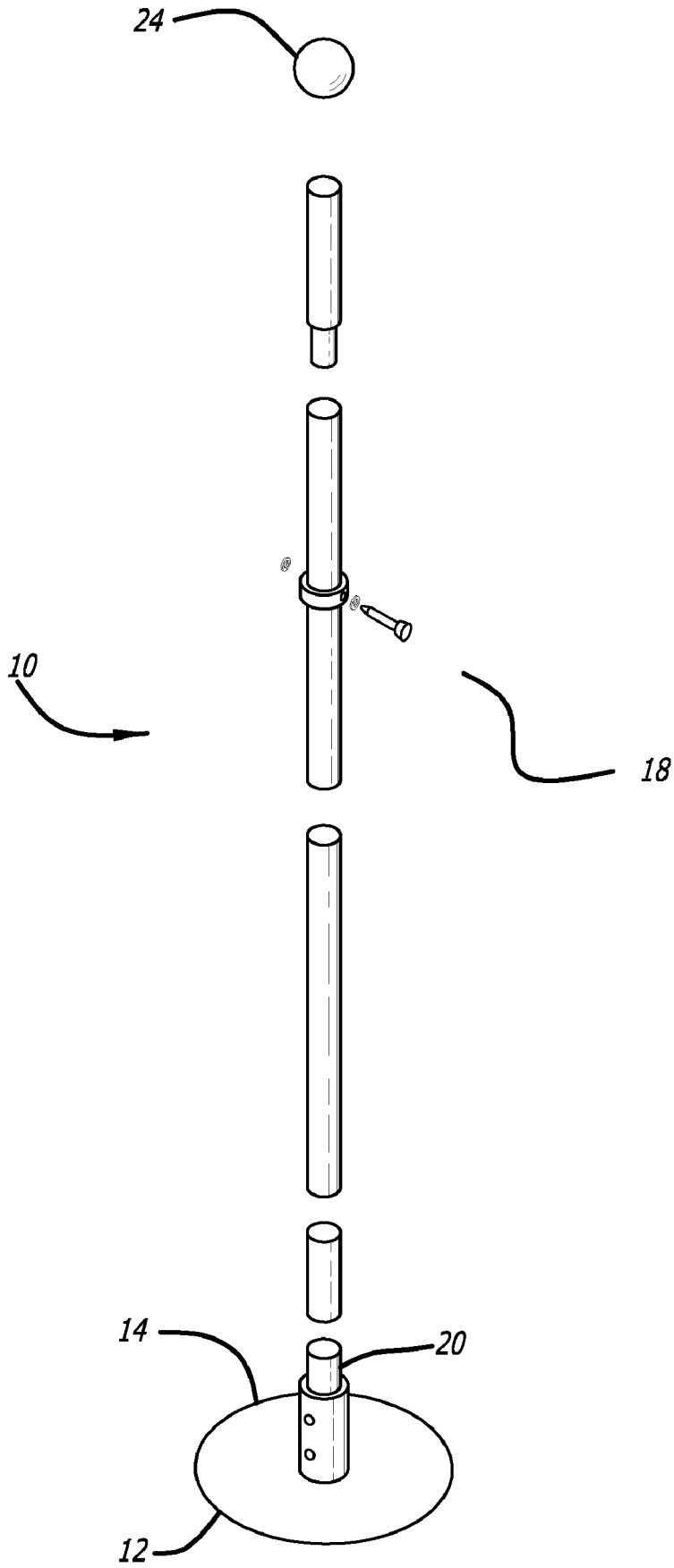
FIG. 1 is an exploded perspective view of a Therapeutic Device according to the present invention.

Turning first to FIG. 1, there is shown a therapeutic device 10 according to the present invention. The assembled device 10 includes a base 12 and a base collar 14. A series of tubes 16, 16', 16" interlock to form a rigid rod structure 18. The rod structure 18 is joined to the base collar 14 with a flexible coupling member 20 which, in the preferred embodiment, is a coil spring that provides little or no resistance to bending. An eye bolt 22 permits attachment to a cable (not shown) that is connected to a weight stack or some other form of resistance to movement. A handle 24 is provided so that a user can grasp the device 10 and utilize the device 10 in an exercise routine.

As shown in FIG. 1, the handle 24 is shown as a sphere. However, a plurality of different shaped handles is available. Other handles which may be articulated or which may pivot or exhibit many degrees of freedom are available, depending upon the routine to be followed by the user and the activity with which the user may be associated.

Figure 2A:
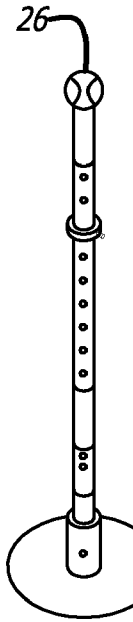
FIGS. 2*a*-2*f*, illustrate various alternative handles for the Therapeutic Device of FIG. 1.
Figure 2B:
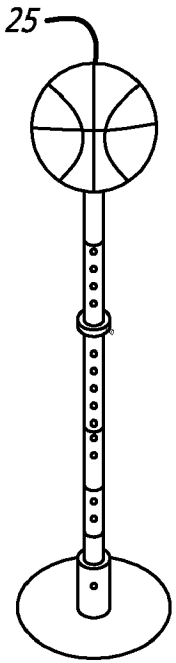
Figure 2C:
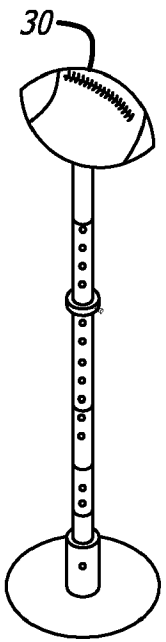
Figure 2D:
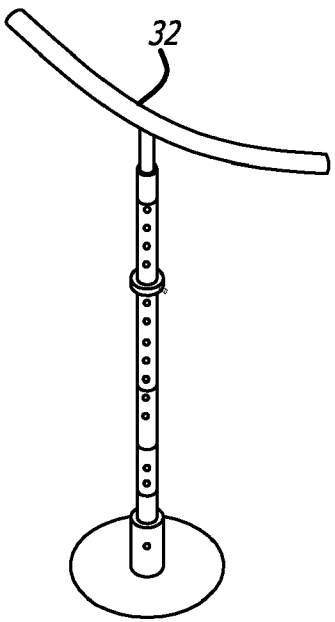
Figure 2E:
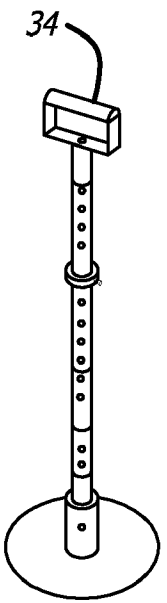
Figure 2F:
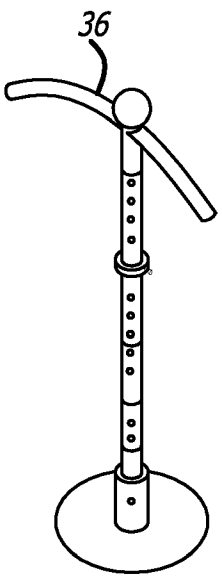
Figure 3A:
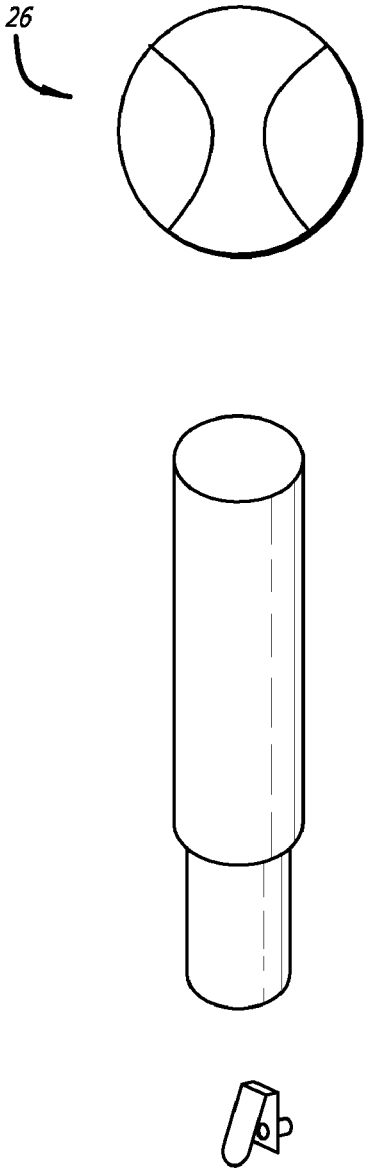
FIGS. 3*a*-3*f* are exploded views of the alternative handles shown in FIGS. 2*a*-2*f*.
Figure 3B:
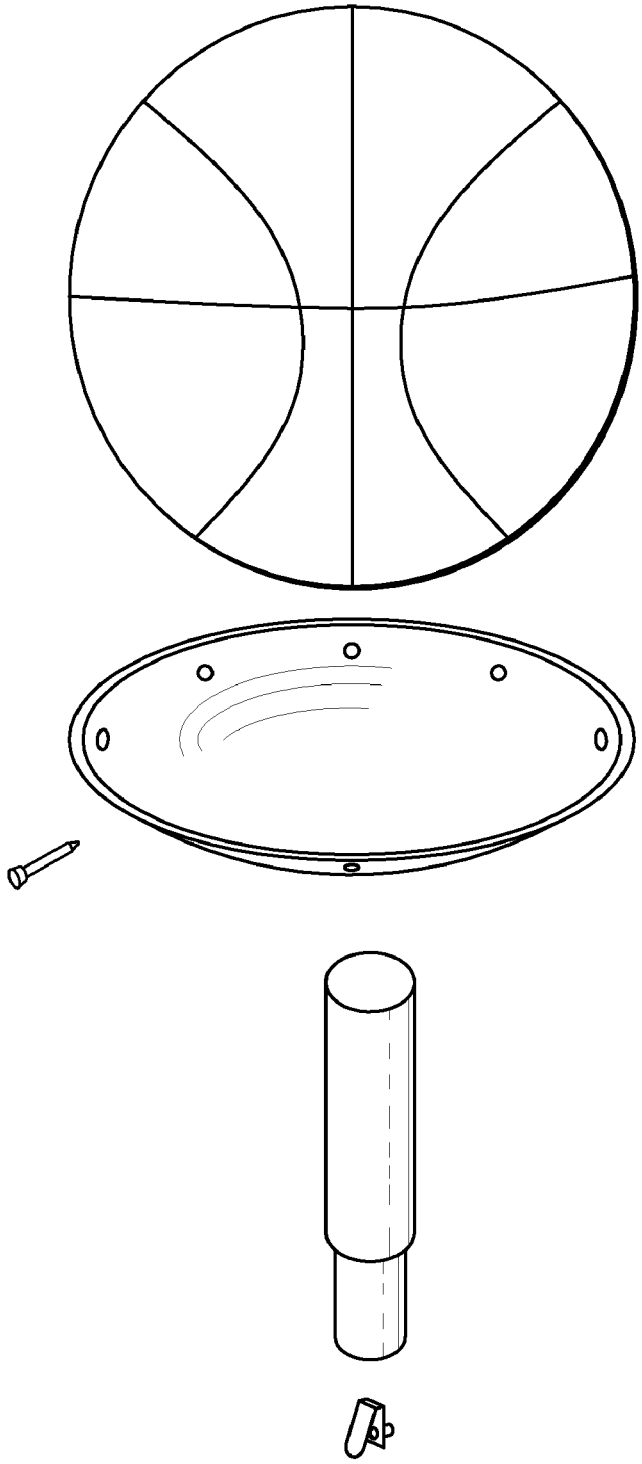
Figure 3C:
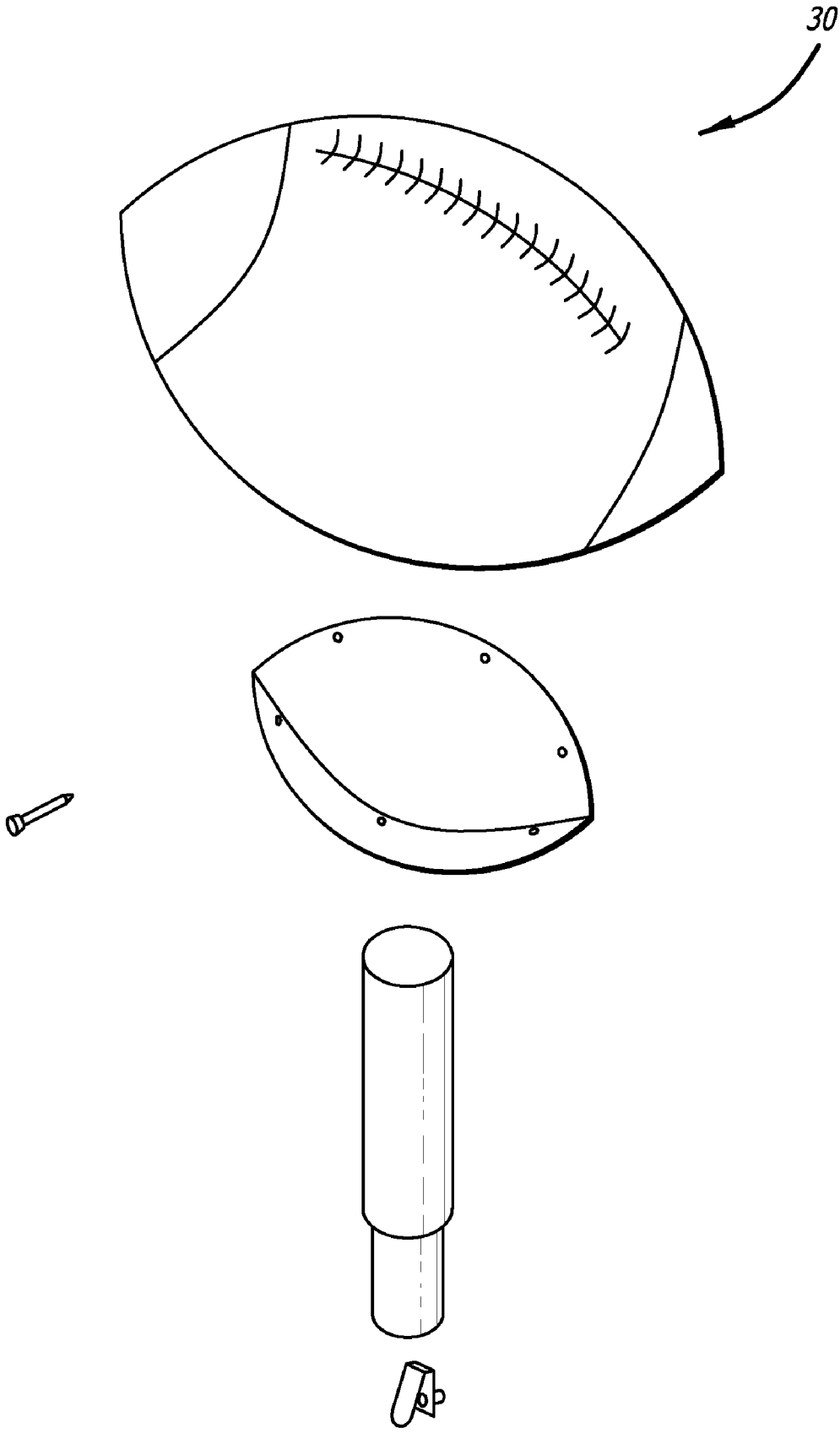
Figure 3D:
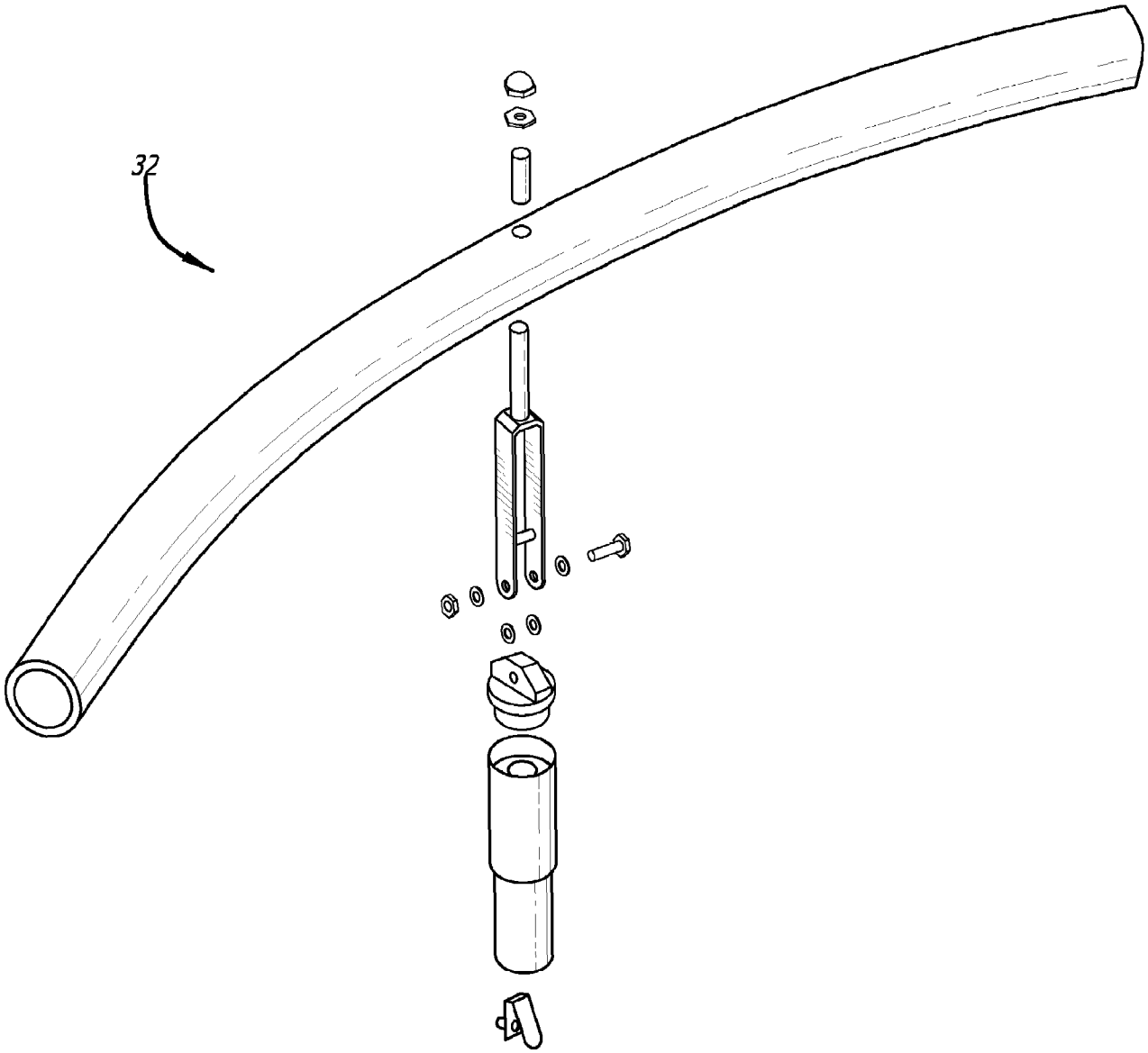
Figure 3E:
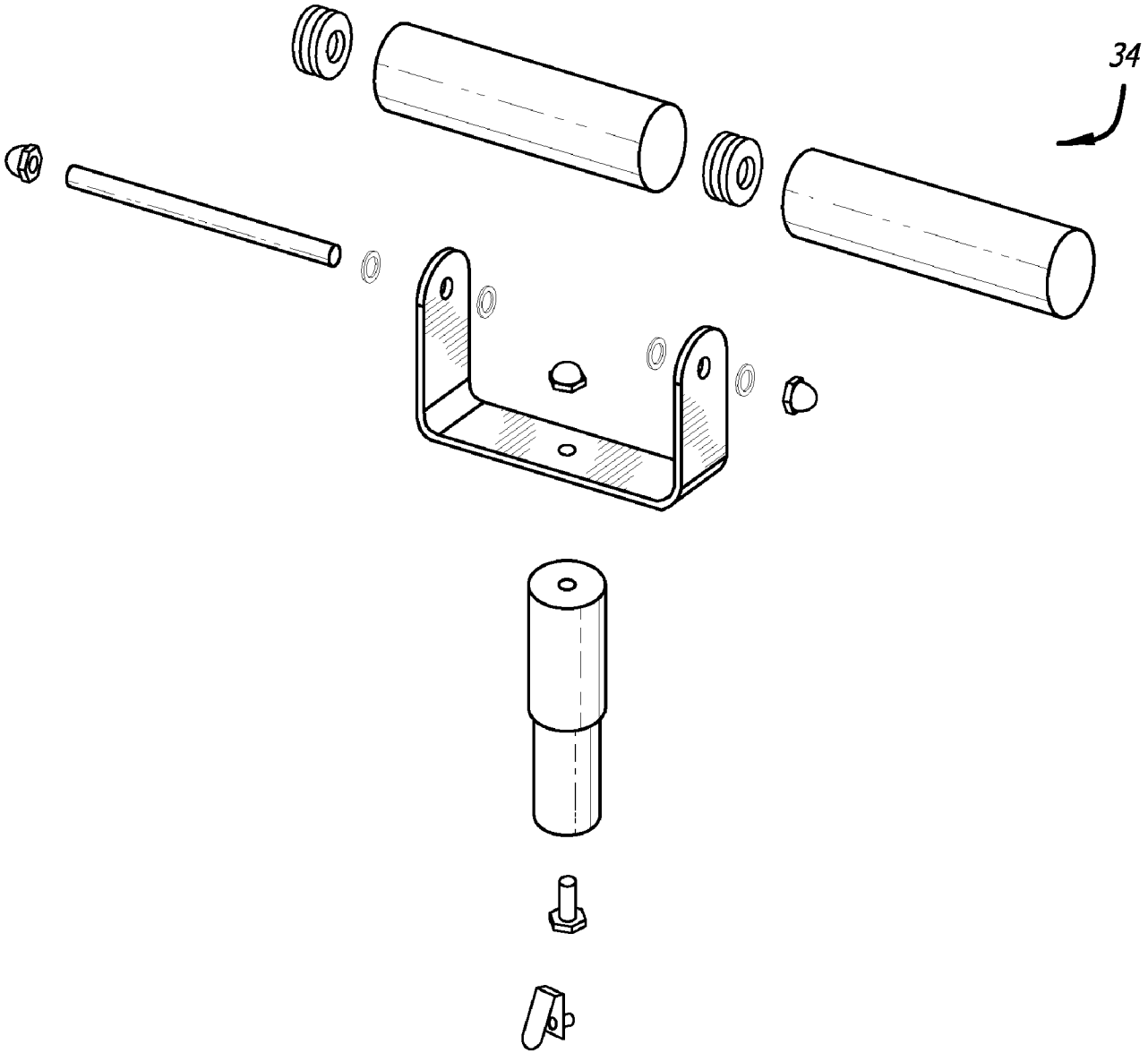
Figure 3F:
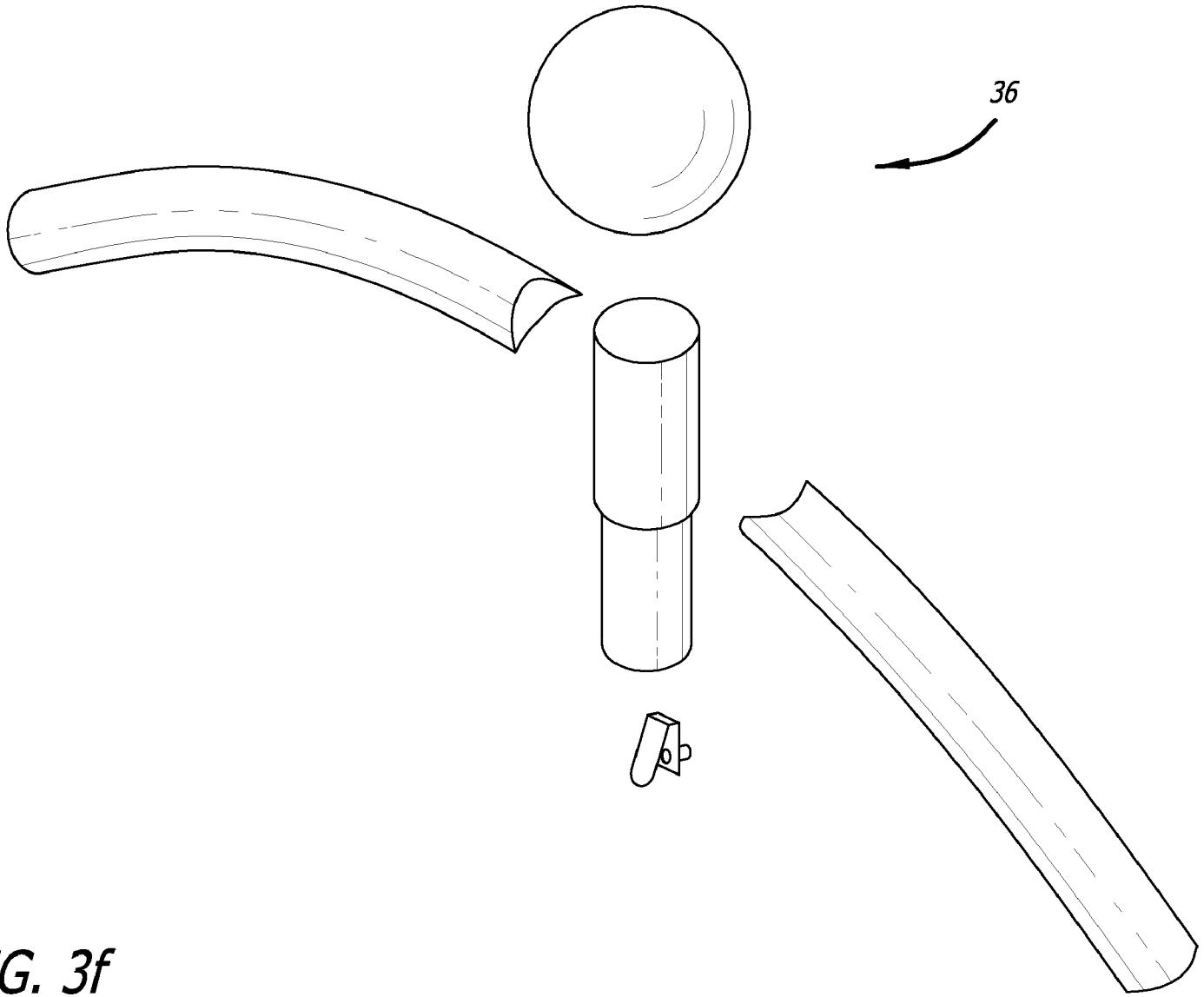

FIG. 2, including FIGS. 2*a* through 2*f* illustrate different handles 24 that might be employed with the device of the present invention. In FIG. 2*a*, there is shown a baseball handle 26. FIG. 2*b* shows a basketball handle 28. FIG. 2*c* shows a football handle 30. FIG. 2*d* shows an articulating arc handle 32. FIG. 2*e* shows a double spiral handle assembly 34. FIG. 2*f* shows a combination of a baseball with a single spiral arc assembly 36.

Attached as FIGS. 3*a*-3*f* are the exploded, detailed assembly drawings for each of the handles 26-36 illustrating the manner of assembling each such handle.

Figure 4:
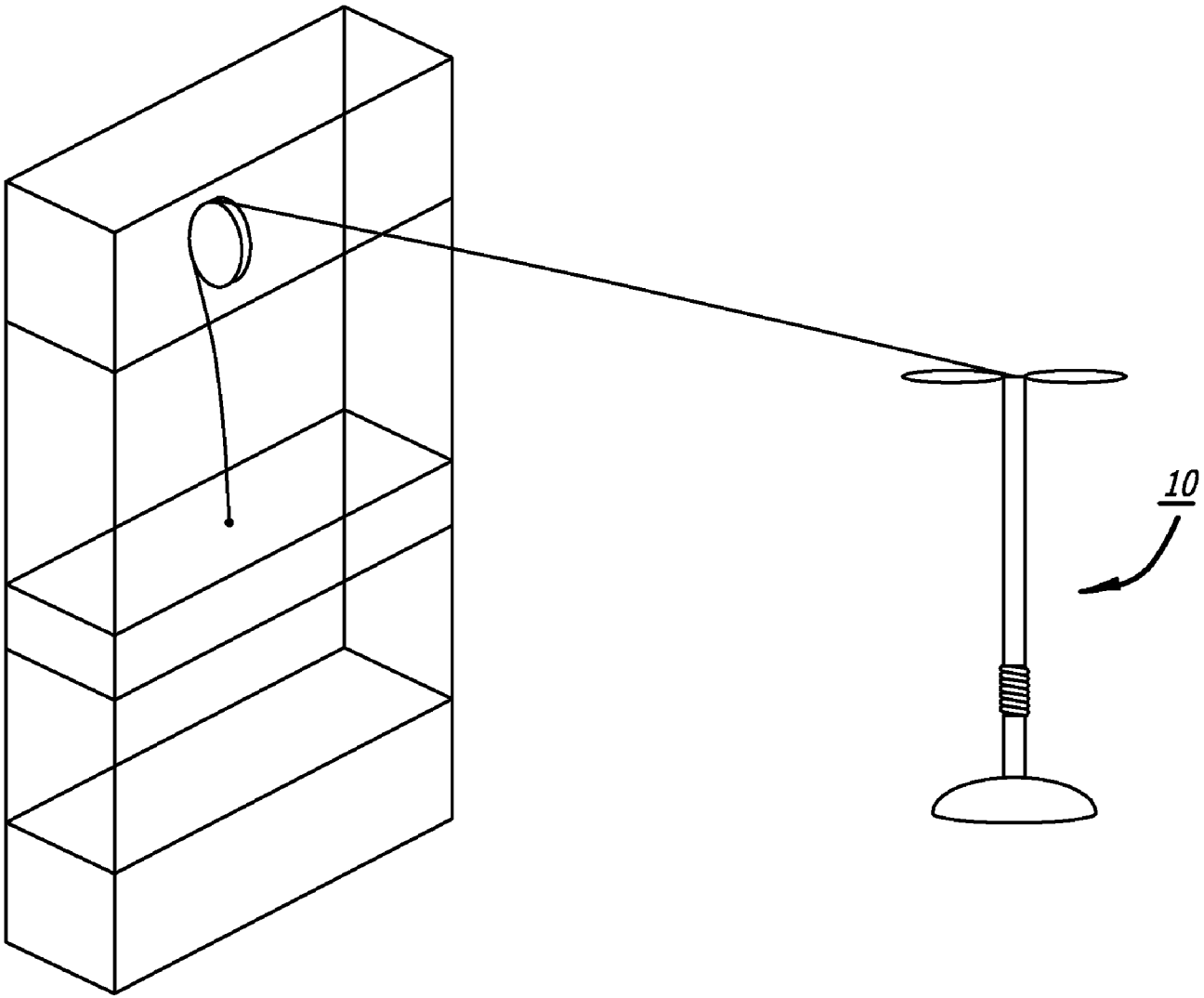
FIG. 4 is a perspective view of the Therapeutic Device of FIG. 1 attached to an adjustable weight set.

Turning next to FIG. 4, there is shown the therapeutic device 10 of the present invention tethered to a weight set 40. The weight set 40 is a conventional structure including a plurality of weight plates 42, each of which can be a standard weight. The structure is designed so that by appropriate adjustment, one or more of the plates 42 are connected to a cable 44 which passes over a pulley 46 and connects to the therapeutic device 10.

Figure 5:
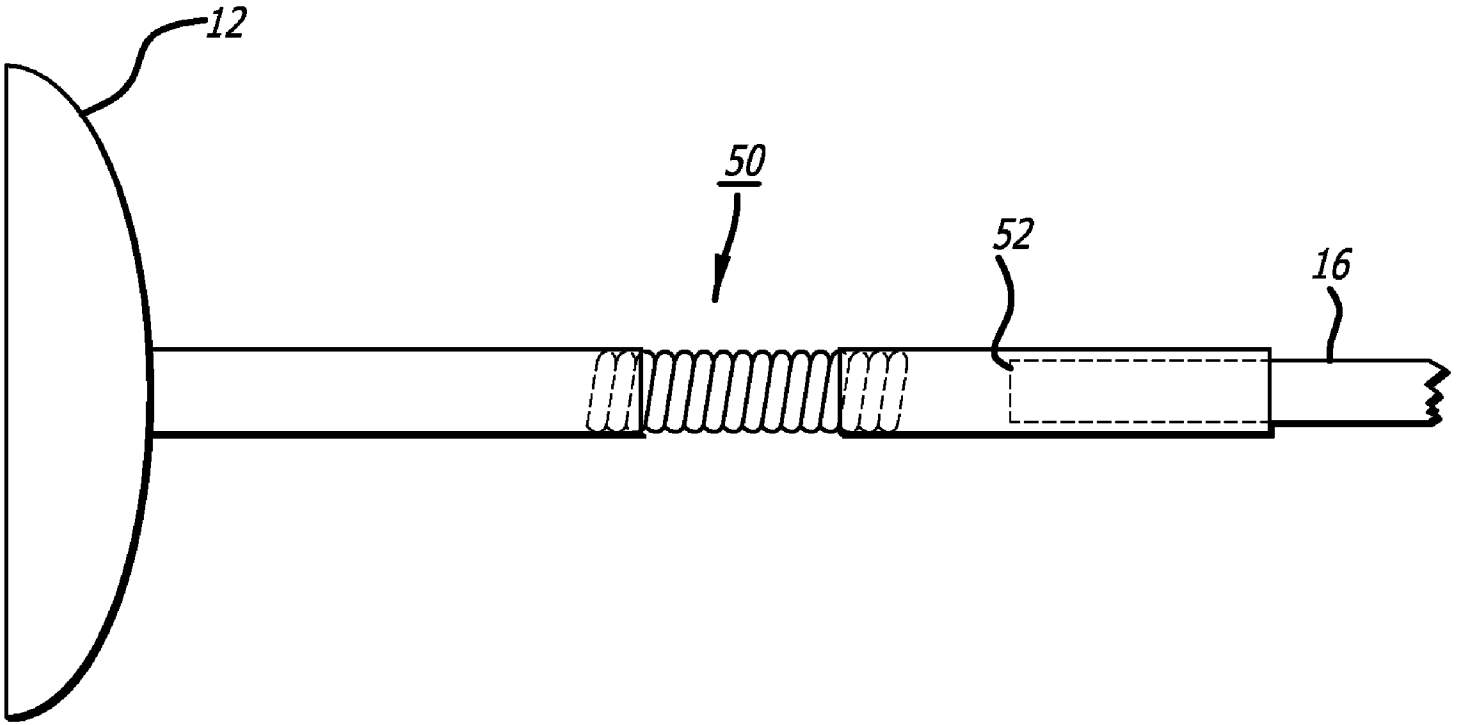
FIG. 5 is a view of an alternative spring assembly joining the pole to a base.

In FIG. 5, there is shown an alternative configuration for the coupling of the device segments 16 to the base 12. In this configuration, a relatively heavy coil spring 50 couples the base 12 to the segments 16. The coil spring 50 is long enough so that over its full length, it provides little or no resistance to the bending of the segments 16. A collar 52 can shorten the length of "free spring" so that, as the exposed spring is shortened, it supplies greater and greater resistance to the bending of the pole. The segments 16 may include a calibration so that a predetermined resistance is represented at each position of the collar 52.

Thus there has been shown and described a novel therapeutic device that can be used for training, exercise and rehabilitation by offsetting some of the effects of gravity on the body as it is bending and stretching.

The invention may be modified by those skilled in the art and should be limited only by the scope of the claims appended hereto.

What is claimed as new is:

1. A physical therapy apparatus comprising:

a weighted base, suitable for holding the physical therapy apparatus in place as it is used;

a spring providing substantially no resistance to bending, connected to said base, suitable for use as a joint;

a rod, connected at one end to said spring, said rod being sufficiently rigid so as to use said spring as a joint and including a connector suitable for the attachment of counter weight means;

a second end, disposed opposite said one end;

a handle element attached to said second end, for enabling use of the physical therapy apparatus;

a cable attached to said connector, and counterbalancing means connected to said cable wherein said source of counterbalancing means is a stack of weight plates.

2. The apparatus of claim 1, wherein said stack of weight plates is connected to a cable which passes over a pulley to supply a range of resistances for various exercises.

3. An exercise apparatus comprising:

a base, suitable for holding the exercise apparatus in place during use;

a spring providing substantially no resistance to bending, connected to said base;

a rod, connected to said spring, sufficiently rigid so as to be rotated using said spring as a joint;

coupling means at said rod free end suitable for use in attaching available handles; and means connecting said rod to counterbalancing means wherein said source of counterbalancing means is a stack of weight plates.

4. The apparatus of claim 3, wherein said connecting means include a pulley system comprising said stack of weight plates connected to a cable which passes over said pulley to supply a range of resistances for various exercises.

5. A physical therapy apparatus comprising:

a weighted base, suitable for holding the physical therapy apparatus in place as it is used;

a spring providing substantially no resistance to bending, connected to said base, suitable for use as a joint;

a rod, connected at one end to said spring, said rod being sufficiently rigid so as to use said spring as a joint;

a connector suitable for the attachment of said rod to counter weight means;

a second end, disposed opposite said one end;

counterbalancing means attached to said connector wherein said source of counterbalancing means is a stack of weight plates; and a handle element attached to said second end, for enabling use of the physical therapy apparatus.

6. The apparatus of claim 5, wherein said counterbalancing means include a pulley system connected to said stack of weight plates by a cable which passes over a pulley which is connected to said handle element to supply a range of resistances for various exercises.

* * * * *